US010401757B2

(12) United States Patent
Ninomiya

(10) Patent No.: US 10,401,757 B2
(45) Date of Patent: Sep. 3, 2019

(54) DEVELOPING DEVICE HAVING A BEARING SUPPORTED FEEDING SCREW

(71) Applicant: CANON KABUSHIKI KAISHA, Tokyo (JP)

(72) Inventor: Takashi Ninomiya, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/114,690

(22) Filed: Aug. 28, 2018

(65) Prior Publication Data

US 2019/0064695 A1 Feb. 28, 2019

(30) Foreign Application Priority Data

Aug. 29, 2017 (JP) ..... 2017-164717

(51) Int. Cl.
*G03G 15/08* (2006.01)
*G03G 21/18* (2006.01)

(52) U.S. Cl.
CPC ..... *G03G 15/0808* (2013.01); *G03G 15/08* (2013.01); *G03G 15/0865* (2013.01); *G03G 15/0887* (2013.01); *G03G 15/0891* (2013.01); *G03G 21/18* (2013.01)

(58) Field of Classification Search
CPC ..... G03G 15/0808; G03G 15/0865; G03G 15/0887
See application file for complete search history.

(56) References Cited

U.S. PATENT DOCUMENTS 5,170,212 A * 12/1992 DeCecca ..... F16C 33/74 384/420
2006/0204282 A1* 9/2006 Yoshida ..... G03G 15/0893 399/254
2016/0216641 A1* 7/2016 Makie ..... G03G 15/0894

FOREIGN PATENT DOCUMENTS

JP 2006-171582 A 6/2006
JP 2011-033706 A 2/2011
JP 2011128403 A * 6/2011

* cited by examiner

*Primary Examiner* — Susan S Lee
(74) *Attorney, Agent, or Firm* — Venable LLP

(57) ABSTRACT

A developing device includes a developer accommodation frame, a feeding screw including a shaft portion and a helical blade to feed the developer in the accommodation frame by rotation thereof, a supporting member provided with a gear engaged with one end portion of the shaft portion to transmit a rotational force to the feeding screw, and a bearing portion for rotatably supporting the supporting member. In a state that the supporting member is supported by the bearing portion, the one end portion is inside the accommodation frame, and a distance between an end portion of the bearing portion in a rotational axis direction and an end portion of the helical blade closest to the bearing portion is larger than a distance between the end portion of the bearing portion and an end surface of the shaft portion.

6 Claims, 3 Drawing Sheets

DEVELOPING DEVICE HAVING A BEARING SUPPORTED FEEDING SCREW

FIELD OF THE INVENTION AND RELATE ART

The present invention relates to a developer storing apparatus which is suitable for an image forming apparatus, such as a printing machine, a copying machine, a facsimileing machine, and a multifunction machine capable of performing two or more functions of the preceding machines, which uses an electrophotographic technology.

An image forming apparatus is provided with a developing device which develops an electrostatic latent image formed on the image bearing member of the image forming apparatus, into a toner image, with the use of developer. A developing device is provided with a casing and conveyance screws. It is structured so that developer is circulated through the internal space of the casing by the conveyance screws. Further, an image forming apparatus is provided with a developer replenishment apparatus, which is an apparatus for replenishing a developing device with developer by an amount which is equal to the amount by which developer was consumed by image formation. A developer replenishment apparatus is provided with a casing and a conveyance screw. It is structured so that developer is conveyed by the conveyance screw.

In recent years, it has become a common practice to form a conveyance screw, such as those described above, of a resinous substance, and also, to form the shaft portion of a conveyance screw, and the blade portion of a conveyance screw, together. Moreover, it has been proposed to structure a developing device so that the portion of a conveyance screw, by which the conveyance screw is borne by the casing of a developing device, is a part of the shaft portion of the conveyance screw, and also, so that the supporting portion of the conveyance screw is fitted with a metallic component for reducing the friction between the supporting portion and the bearing portion of the casing, and also, with gears for rotating the conveyance screw (Japanese Laid-open Patent Application No. 2006-171582).

On the other hand, some conveyance screws, the main shaft and spiral blade of which are formed together, of a resinous substance, are structured so that the main shaft of each conveyance screw is fitted with an auxiliary shaft which is significantly slipperier (less in friction) than the main shaft, and also, so that the conveyance screws are borne by the bearing, by their auxiliary shaft. (Japanese Laid-open Patent Application No. 2011-33706). Since they are structured as described above, the gears can be easily attached to the conveyance screws, and the friction between the conveyance screws and the bearings therefor are substantially smaller than that between the conveyance screws and bearing therefore, in any conventional developing device (developing storing apparatus) (Japanese Laid-open Patent Application No. 2011-33706). However, a conveyance screw such as those described above suffers from the following problem. That is, if it is structured so that, in terms of its lengthwise direction, its lengthwise end on the auxiliary shaft side coincides with the lengthwise end of the spiral blade, or the spiral blade is protrusive toward the auxiliary shaft beyond the end of the main shaft, the end of the spiral blade rubs against the wall which opposes the spiral blade, increasing therefore the amount of load, to which the conveyance screw is subjected as it is rotated.

SUMMARY OF THE INVENTION

Thus, the primary object of the present invention is to provide a developing device which is structured so that a supporting member is attached to its conveyance screw, and yet, is substantially smaller in rotational load than any conventional developing device.

According to an aspect of the present invention, there is provided a developing device comprising an accommodation frame for accommodating a developer; a feeding screw including a shaft portion and a helical blade formed on said shaft portion and configured to feed the developer in said accommodation frame by rotation thereof; a supporting member provided with a gear engaged with one end portion of said shaft portion to transmit a rotational force to said feeding screw; and a bearing portion for rotatably supporting said supporting member, wherein in a state that said supporting member is supported by said bearing portion, said one end portion is inside said accommodation frame, and wherein in the state that said supporting member is supported by said bearing portion, a first distance between an end portion of said bearing portion in a rotational axis direction and an end portion of said helical blade closest to said bearing portion is larger than a second distance between the end portion of said bearing portion and an end surface of said shaft portion.

Further features of the present invention will become apparent from the following description of exemplary embodiments with reference to the attached drawings.

DESCRIPTION OF THE EMBODIMENTS

[Image Forming Apparatus]

Figure 1:
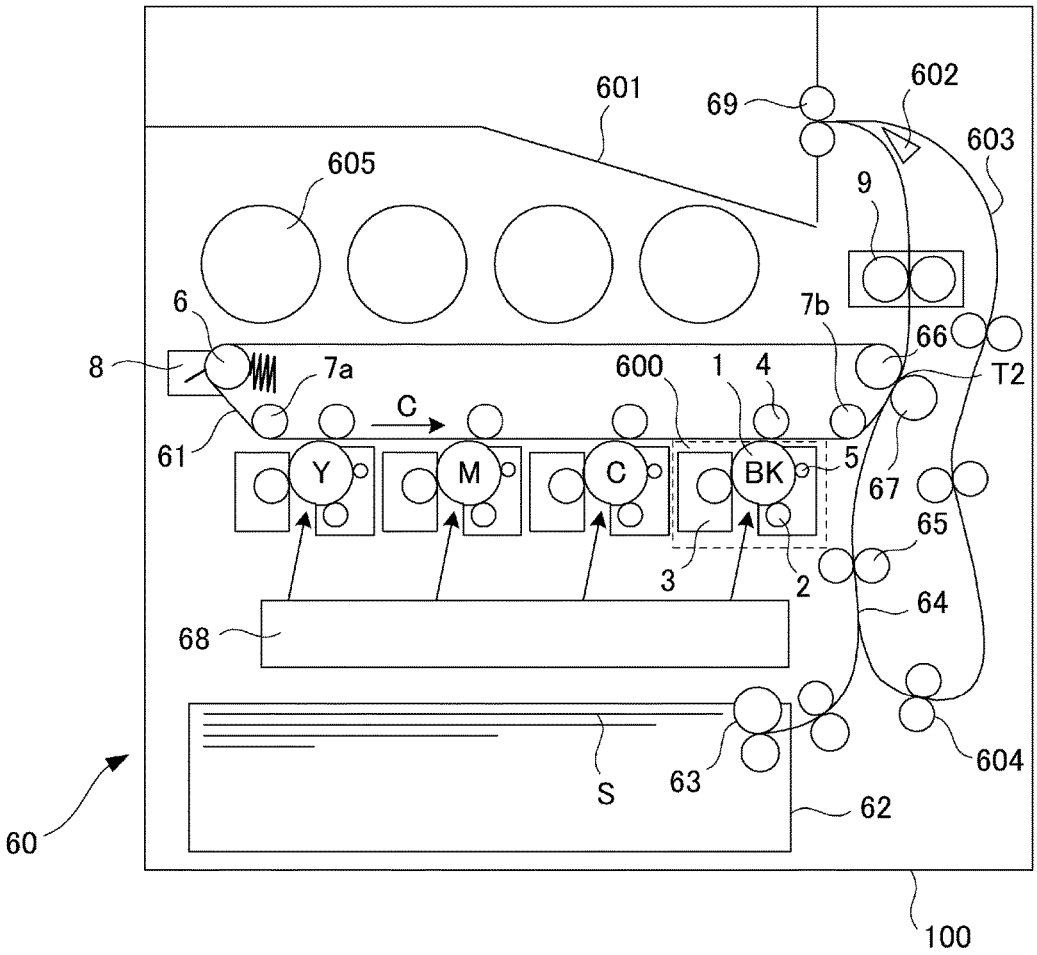
FIG. 1 is a schematic sectional view of a typical image forming apparatus which is compatible with a developer storing apparatus in accordance with the present invention; it shows the structure of the image forming apparatus.

Hereinafter, the developer storing apparatus in this embodiment is described. To begin with, referring to FIG. 1, an image forming apparatus which is suitable in structure to employ the developing device in this embodiment is described about it structure. The image forming apparatus 60 shown in FIG. 1 is a color image forming apparatus which is of the so-called intermediary transfer type, and also, of the so-called tandem type. It has the main assembly 100 and an intermediary transfer belt 61. It employs four image forming portions 600, which are different in the color of the images they form. It is structured so that each of the four image forming portions 600 opposes the intermediary transfer belt 61.

First, the recording medium conveyance in the image forming apparatus 60 is described. The image forming apparatus 60 is structured so that a substantial number of sheets S of recording medium can be stored in layers in its recording medium storage 62 (cassette). Each sheet S is fed into the main assembly 100, by a feed roller 63, in synchronism with image formation timing. As for the method for feeding a sheet S of recording medium into the main assembly 100, such a feeding method that relies on the friction between a feed roller and the sheet S is used, for example. As a sheet S of recording medium is fed into the main assembly 100 by the feed roller 63, it is conveyed to a pair of registration rollers 65 disposed in the recording medium conveyance passage 64. As it reaches the pair of registration rollers 65, it is adjusted in attitude (if it is being conveyed askew). Then, it is released by the pair of registration rollers 65 so that it will reach the secondary transferring portion T2 with preset timing. The secondary transferring portion T2 is the nip (transfer nip) which the secondary transfer outside roller 66 and secondary transfer inside roller 67, which oppose each other, form between them. While the sheet S is conveyed through the secondary transferring portion T2, a combination of a preset amount of pressure, and a preset amount of electrostatic load (bias), is applied between the second transfer outside roller 66 and second transfer inside roller 67. Consequently, the toner images are adhered to the surface of the sheet S.

Next, the process through which an image which is to be conveyed to the secondary transferring portion T2 with similar timing to the timing with which the sheet S is conveyed to the secondary transferring portion T2, is formed, is described. First, image forming portions 600 are described. The four image forming portions 600, which form four images, different in color, one for one, are basically the same in structure, although they are different in the color of the toner they use. Therefore, the image forming portion 600 for forming a black (BK) image is described as the one that represents the four image forming portions 600.

The image forming portion 600 is made up of a photosensitive drum 1, charging apparatus 2, a developing device 3, a photosensitive drum cleaning apparatus, etc. As the photosensitive drum 1 is rotationally driven, its peripheral surface is uniformly charged. Then, an electrostatic latent image is formed on the peripheral surface of the photosensitive drum 1 by the exposing apparatus 68, which is driven in response to the signals which represent the information of the image to be formed. Then, the electrostatic latent image formed on the photosensitive drum 1 is developed into a visible image through the development process carried out by the developing device which uses toner. Thereafter, a combination of a preset amount of pressure, and a preset amount of electrostatic load (bias) is applied between the photosensitive drum 1 and an intermediary transfer belt 61 by the primary transferring apparatus 4 disposed so that it opposes the photosensitive drum 1 with the presence of the intermediary transfer belt 61 between itself and photosensitive drum 1. Consequently, the toner image formed on the peripheral surface of the photosensitive drum 1 is transferred (primary transfer) onto the intermediary transfer belt 61. Transfer residual toner, or a small amount of toner remaining on the peripheral surface of the photosensitive drum 1 after the primary transfer, is removed by the photosensitive drum cleaner 5 (cleaning blade, or the like), in order to ready the peripheral surface of the photosensitive drum 1 for the following image formation process. In the case of the image forming apparatus structured as shown in FIG. 1, there are four image forming portions 600, which form yellow (Y), magenta (M), cyan (C) and black (BK) toner images, one for one. However, the number of monochromatic color images into which the image to be formed is to be separated does not need to be four. Further, the order in which the four toner images, different in color, are to be formed does not need to be the same as the one through which the image forming apparatus 100 in this embodiment forms a multicolor image. By the way, it is assumed here that the developing device 3 uses two-component developer, which is a mixture of toner and magnetic carrier. In order to replenish the developing device 3 with developer by the amount by which toner is consumed by image formation, the image forming apparatus 60 is provided with a toner bottle 605 (container for replenishment toner), in which replenishment developer is stored in advance. The replenishment toner in the toner bottle 605 is conveyed by an unshown conveyance screw through a replenishment toner conveyance passage to replenish the developing device 3 with replenishment toner.

Next, the intermediary transfer belt 61 is described. The intermediary transfer belt 61 is an endless belt. It is suspended and tensioned by a combination of a tension roller 6, a secondary transfer inside roller 66, and a pair of idler rollers 7*a* and 7*b*. It is moved in the direction indicated by an arrow mark C in the drawing. The secondary transfer inside roller 66 doubles as a driving roller for driving the intermediary transfer belt 61. The image formation processes carried out in the image forming portions 600, which form yellow (Y), magenta (M), cyan (C) and black (BK) images, one for one, are carried out with such timing that they are sequentially layered on the intermediary transfer belt 61, starting from the one formed by the most upstream image forming portion 600. Consequently, a full-color toner image is effected on the intermediary transfer belt 61. Then, the full-color toner image is conveyed to the secondary transferring portion T2. By the way, the secondary transfer residual toner, or the toner remaining on the downstream side of the intermediary transfer belt 61 relative to the secondary transferring portion T2, is removed from the intermediary transfer belt 61 by a cleaning apparatus 8 for removing the secondary transfer residual toner. The cleaning apparatus 8 conveys the developer which it has removed, with its unshown conveyance screw, to recover the removed developer into an unshown container for recovered developer.

Since a sheet S of recording medium is fed and conveyed as described above, and also, four toner images, different in color, are formed as described, the timing with which each sheet S of recording medium arrives at the secondary transferring portion T2 coincides with the timing with which the full-color toner image arrives at the secondary transfer portion T2, and the full-color image is transferred (secondary transfer) onto the sheet S. Then, the sheet S is conveyed to a fixing apparatus 9, in which the toner image (unfixed) on the sheet S is fixed to the sheet S by a combination of a preset amount of pressure, and a preset amount of heat. After the fixation of the toner image to the sheet S, the sheet S is discharged into a delivery tray 601 by the normal rotation of a pair of discharge rollers 69, or it is checked if the image forming apparatus 60 is in the two-sided image formation mode.

If the image forming apparatus 60 is in the two-sided image formation mode, the sheet S is conveyed by the normal rotation of the pair of discharge rollers 69 until the trailing edge of the sheet S passes by a switching member 602. Then, the discharge rollers 69 are rotated in reverse so that the edge of the sheet S, which was the leading edge while the pair of discharge rollers 69 were normally rotated, becomes the trailing edge. Then, the sheet S is conveyed to the two-sided printing passage 603. Then, it is conveyed to the sheet conveyance passage 64 for the second time by a pair of re-feed rollers 604. The image formation process, which comes thereafter to form the back surface of the sheet s is similar to the one described above. Therefore, it is not described.

[Process Cartridge]

In this embodiment, the image forming portion 600, described above, which has the photosensitive drum 1, charging apparatus 2, developing device 3, photosensitive drum cleaner 5, etc., is unitized as a process cartridge, which is removably installable in the apparatus main assembly 100. The process cartridge (image forming portion 600) and apparatus main assembly 100 are structured so that the former can be slid into, or out of, the latter in the direction parallel to the axial line of the photosensitive drum 1 (lengthwise direction). The process cartridge is shown in FIG. 2.

Figure 2:
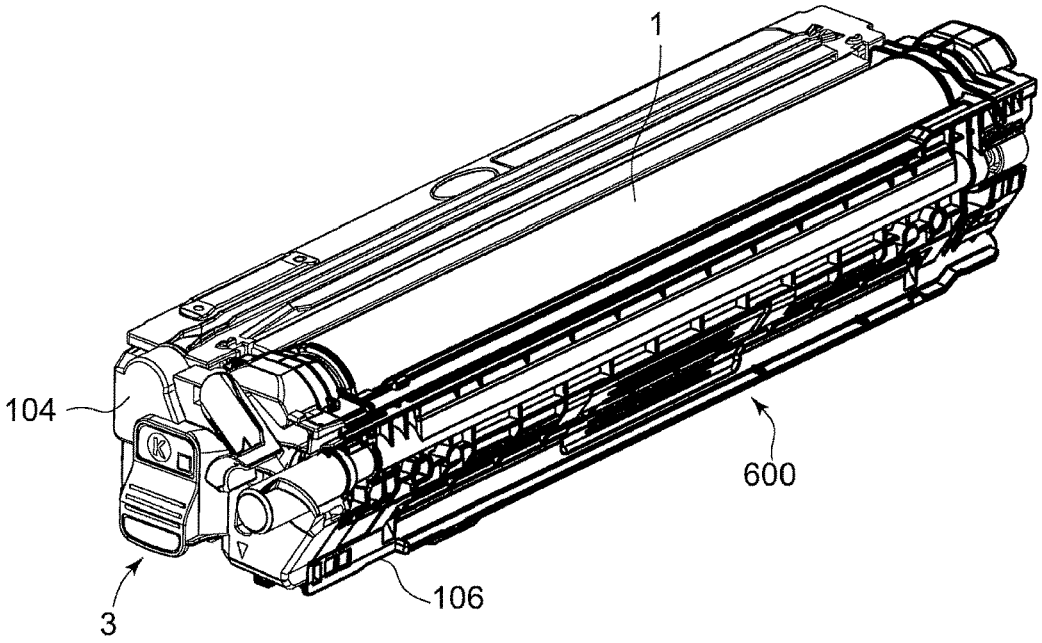
FIG. 2 is a perspective view of one of the image forming portions of the image forming apparatus shown in FIG. 1.

Referring to FIG. 2, the process cartridge (image forming portion 600) comprises a casing which is a combination of a top cover (unshown), a pair of side covers 104, a bottom housing 106, etc. It comprises also the photosensitive drum 1, developing device 3, etc., described above, which are disposed in the casing. The photosensitive drum 1 is disposed so that its rotational axis is parallel to the lengthwise direction of the casing. The developing device 3 is disposed so that the rotational axis of its development sleeve 10 (which will be described later with reference to FIG. 3) is parallel to the axial line of the photosensitive drum 1. That is, referring to FIG. 3, the development sleeve 10 is disposed in parallel to the photosensitive drum 1 so that it can supply the photosensitive drum 1 with developer during image formation. Further, the developing device 3 is provided with a stirring screw and a development screw, as conveyance screws, which are rotationally disposed in the developing device 3 to circulate developer through the internal space in the developing device 3 (FIG. 3).

[Developing Device]

Figure 3:
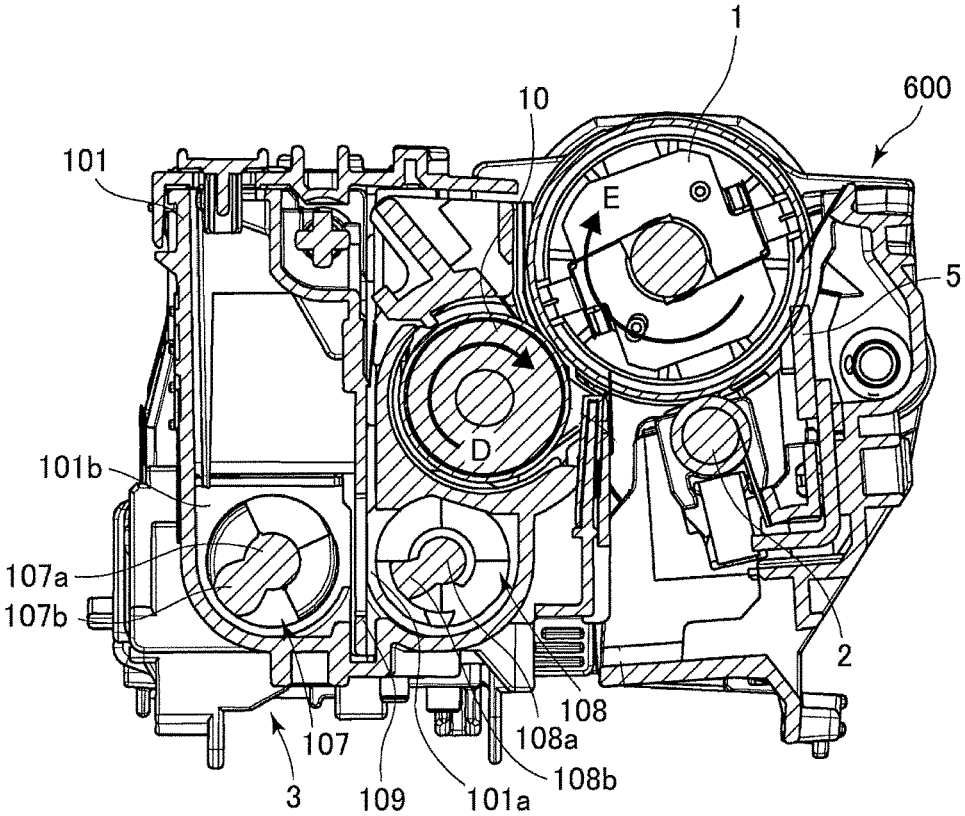
FIG. 3 is a sectional view of the image forming portion shown in FIG. 3.
Figure 4:
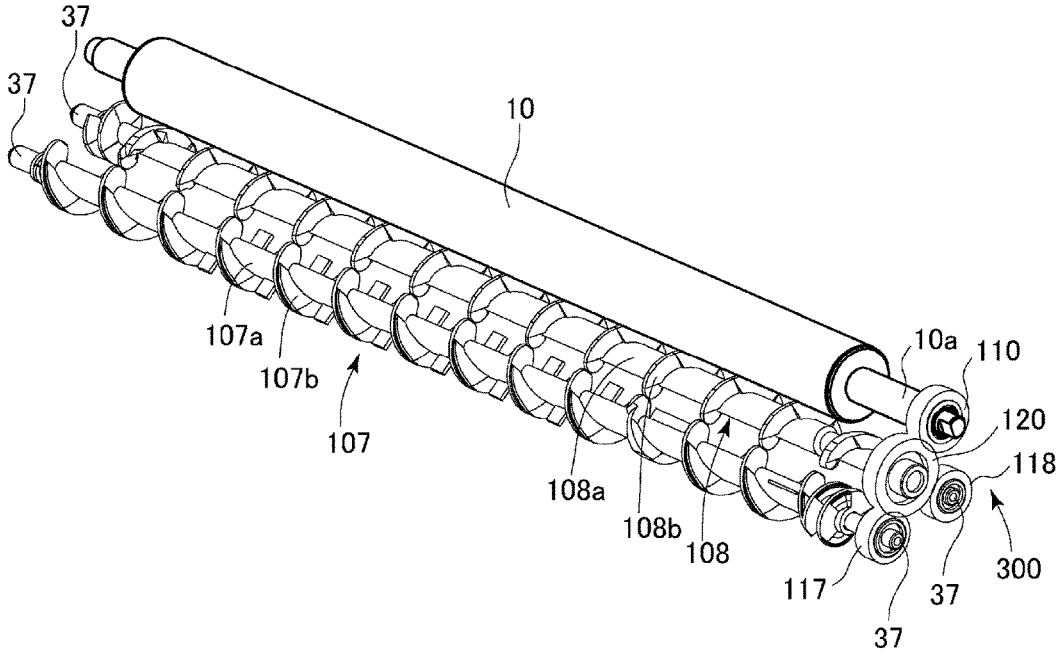
FIG. 4 is a perspective view of the pair of screws of the developing device shown in FIG. 3.
Figure 5:
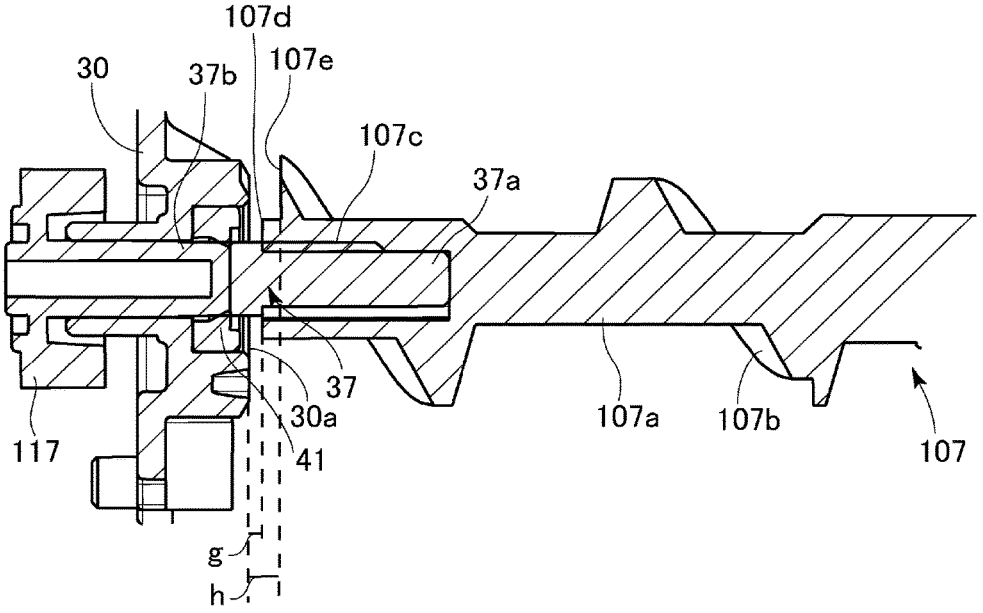
FIG. 5 is an enlarged sectional view of the conveyance screw bearing attached to the casing of the developing device, and the adjacencies of the bearing.

Next, referring to FIGS. 3-5, the developing device 3, which functions also as a developer storing apparatus, is described about its structure. Referring to FIG. 3, the developing device 3 has a developing means container 101, which holds two-component developer made up of toner and carrier. The developing means container 101, which functions as a holding member, has a partition wall 109, which is roughly in the center of the developing means container 101 in terms of the horizontal direction which is parallel to the drawings. The partition wall 109 divides the internal space of the developing device 3 into a development chamber 101*a* and a stirring chamber 101*b*, which are in connection to each other through the openings (unshown), with which the lengthwise end portions of the partition wall 109 are provided, one for one. Thus, the two chambers 101*a* and 101*b*, and openings, make up a passage through which developer is circulated through the internal space of the developing device 3.

In the development chamber 101*a*, a development screw 108 is rotatably disposed. In the stirring chamber 101*b*, a stirring screw 107 is rotatably disposed. The stirring screw 107, or feeding screw, is made up of a shaft portion 107*a*, and a blade portion 107*b* which is spirally wound around the shaft portion 107*a*. The development screw 108, also a feeding screw, is made up of a shaft portion 108*a*, and a blade portion 108*b* which is spirally wound around the shaft portion 108*a*. The two screws 107 and 108 are supported by the bearing portions 30 (FIG. 5) of the developing means container 101 of the developing device 3, by their shaft portions 107*a* and 108*a*, respectively. The shaft and blade portions of each of the two screws 107 and 108 are formed together, of a resinous substance such as poly-acetal (POM), poly-carbonate (PC), and polyamide (PA), to which developer is unlikely to adhere, and which is highly resistant to frictional wear. As these stirring screw 107 and development screw 108 are rotated, the developer in the developing means container 101 is circulated through the internal space of the container 101 while being stirred. Referring to FIG. 4, in the case of this embodiment, the lengthwise ends of the shaft portion 107*a*, in terms of the direction parallel to the axial line of the shaft portion 107*a*, are fitted with a pair of supporting shafts 37, or supporting members, one for one, by which the stirring screw 107 is supported by the bearing portions of the developing means container 101. The lengthwise ends of the shaft portion 108*a*, also, are fitted with a pair of supporting shafts 37, or supporting members, one for one, by which development screw 108 is supported by the bearing portions of the developing means container 101 The supporting shafts 37 are connected to the shaft portions 107*a* and 108*a* with the use of transition fitting or crimping.

The developing device 3 is structured so that its development sleeve 10 and screws (107 and 108) do not independently operate from each other. They are rotated by the rotational driving force transmitted thereto from a motor or the like driving force source, with which the apparatus main assembly 100 (FIG. 1) is provided. Thus, the lengthwise end portion (bottom-right portion in drawing) of the process cartridge, by which the process cartridge is in connection to the apparatus main assembly 100 is provided with a driving portion 300, which transmits rotational driving force to the development sleeve 10 and screws (107 and 108) from the apparatus main assembly 100, as shown in FIG. 4.

The driving portion 300 has gears 110, 117 and 118 for driving the development sleeve 10, stirring screw 107, and development screw 108, respectively. The gears 110, 117 and 118 are formed of such resinous substance as poly-acetal (POM), for example. The driving portion 300 has also an intermediary gear 120 which transmits rotational driving force to these gears 110, 117, and 118 from an unshown external driving force source (motor, for example), by being in connection to these gears 110, 117 and 118. The development sleeve 10, via shaft 10*a*, and screws (107 and 108) are rotated by the rotational driving force transmitted to the gears 110, 117 and 118 by way of the intermediary gear 120 from the external driving force source. The gears 117 and 118 are greater in diameter than the shaft portions 107*a* of the stirring screw 107, and the shaft portion 108*a* of the development screw 108, respectively.

Next, the stirring screw 107 is described in detail. FIG. 5 is an enlarged sectional view of one of the lengthwise end portions of the stirring screw 107, corresponding bearing portion 30 of the developing means container 101, and their adjacencies. By the way, the development screw 108 is virtually the same in structure as the stirring screw 107. Therefore, it is not described.

Referring to FIG. 5, the stirring screw 107 in this embodiment has the cylindrical shaft portion 107*a*, spiral blade 107*b*, and supporting shaft 37. The spiral blade 107*b* and shaft portion 107*a* are formed together. The supporting portion 37 is attachable to the corresponding lengthwise end portion of the shaft portion 107*a*, in terms of the direction parallel to the rotational axis of the shaft portion 107*a*. It is such a member that functions as an extension of the shaft portion 107*a* in terms of the direction parallel to the axial line of the shaft portion 107*a*. Each of the lengthwise end portions of the shaft portion 107*a* is provided with a groove 107*c* (recess, socket), the cross-section of which, in terms of the direction perpendicular to the rotational axis of the shaft portion 107*a*, looks like an inversely positioned letter "T", whereas the corresponding end portion 37*a* of the supporting shaft 37 is shaped like a plug, which matches the groove 107*c* in shape. Therefore, the shaft portion 107*a* and supporting shaft 37 are rotatable in synchronism with each other. Further, the supporting shaft 37 is provided with a cylindrical portion 37*b*, which is supported by the bearing portion 30 of the developing means container 101, and which can slide on the inward surface of the bearing portion 30 of the developing means container 101. As the supporting shaft 37 is positioned so that its cylindrical portion 37*b* slides on the inward surface of the bearing portion 30, the stirring screw 107 is borne by the bearing portion 30 of the developing means container 101 (which hereafter will be referred to as container bearing portion 30). By the way, instead of providing the shaft portion 107*a* with the groove 107*c* as in this embodiment, the supporting shaft 37 and shaft portion 107*a* may be provided with the groove (37*c*), and the plug-like portion (107*c*), respectively.

The container bearing portion 30 is a cylindrical slide bearing, for example. It can be removably fitted in a hole, with which one of the side walls of the developing means container 101, which is formed of plastic or the like resinous substance, is provided. It is positioned in alignment with the rotational axis of the stirring screw 107 so that it opposes the stirring screw 107. In order to prevent developer from leaking out of the developing means container 101 through the container bearing portion 30, the container bearing portion 30 is fitted with a sealing member 41. By the way, the container bearing portion 30 wears faster than the supporting shaft 37 (portion 37*b*), which is an object to be borne by the container bearing portion 30, but is slipperier than the supporting shaft 37. It is desired to be formed of a resinous substance, such as poly-acetal, which contains fluorine or the like. For example, if the supporting shaft 37 is formed of poly-acetal (POM), it is desired that the container bearing portion 30 is formed of polyamide (PA). This combination is desirable in that it can provide a combination of the supporting shaft 37 and container bearing portion 30, which is highly durable, and yet, low in friction.

Further, the supporting shaft 37 is provided with the aforementioned gear 117 (FIG. 4), which is attached to the opposite end of the supporting shaft 37 from the cylindrical portion 37*b*, by which the supporting shaft 37 is borne. The gear 117 is formed together with the cylindrical portion 37*b*. The cylindrical portion 37*b* is smaller in diameter than the gear 117 and shaft portion 107*a*. In the case of this embodiment, therefore, the supporting shaft 37 can be attached to the shaft portion 107*a* by positioning supporting shaft 37 and shaft portion 107*a* in a manner to sandwich the container bearing portion 30, and then, moving the supporting shaft 37 toward the shaft portion 107*a* in a manner to be put through the container bearing portion 30, for the following reason. That is, if the supporting shaft 37 is attached to the shaft portion 107*a* in advance, the gear 117, which is greater in diameter than the cylindrical portion 37*b*, gets in the way of putting the cylindrical portion 37*b* through the container bearing portion 30, preventing the container bearing portion 30 from bearing the shaft portion 107*a*. This is how the stirring screw 107 is borne by the container bearing portion 30, by the supporting shaft 37.

In order to prevent the container bearing portion 30 and shaft portion 107*a* from rubbing against each other while stirring screw 107 is rotated, there is provided a preset amount (1-3 mm, for example) of gap between the end surface 30*a* of the container bearing portion 30, and the end surface 107*d* of the shaft portion 107*a*, which face each other. The end surface 107*d* of the shaft portion 107*a* coincides with the border between the shaft portion 107*a* and supporting shaft 37. In terms of the direction parallel to the axial line of the stirring screw 107, the first gap (h), or the gap between the end surface 30*a* of the container bearing portion 30, and the end 107*e* of the spiral blade 107*b*, is greater than the second gap (g), or the gap between the end surface 30*a* of the container bearing portion 30 and end surface 107*d* of the shaft portion 107*a*. It is desired that the difference between the second gap (h) and first gap (g) is no less than 2 mm. That is, the supporting shaft 37 is connected to the shaft portion 107*a* in such a manner that after the attachment of the supporting shaft 37 to the shaft portion 107*a*, the distance between the end 107*e* of the spiral blade 107*b* and the end surface 30*a* of the container bearing portion 30 is greater than the distance between the end surface 107*d* of the shaft portion 107*a* and the end surface 30*a* of the container bearing portion 30; the shaft portion 107*a*, supporting shaft 37, and container bearing portion 30 are formed and positioned so as described above.

As described above, in this embodiment, the objective of preventing the stirring screw 107 (or development screw 108) from wobbling while it is rotated, and the objective of preventing the developer agglomeration which is attributable to the rotation of the stirring screw 107, are accomplished by the adoption of the simple structural arrangement for the developing device 3 (developer containing apparatus) described above. That is, in this embodiment, the developing device 3 (developer storing apparatus) was structured so that a preset amount of gap is provided between the end surface 30*a* of the container bearing portion 30, and the end surface 107*d* of the shaft portion 107*a* (shaft portion 107*a* is positioned closer to container bearing portion 30), as described above. Therefore, this embodiment makes it possible to reduce the distance between the shaft portion 107*a* and container bearing portion 30. That is, the border area between the shaft portion 107*a* and supporting shaft 37, in which the wobbling is likely to occur, is closer to the container bearing portion 30. Therefore, the stirring screw 107 is unlikely to wobble as it is rotated.

Further, in this embodiment, the developing device 3 (developer storing portion) was structured so that the end 107*e* of the spiral blade 107*b* is positioned as far as possible from the end surface 107*d* of the shaft portion 107*a*, while keeping its distance from the end surface 30*a* of the container bearing portion 30 no less than 1 mm, and no more than 2 mm. With the adoption of the structural arrangement described above, it is possible to prevent the spiral blade 107*b*, which is greater in peripheral velocity than the shaft portion 107*a*, from shifting excessively close to the container bearing portion 30. Therefore, it is possible to prevent the problem that while the stirring screw 107 is rotated, developer is likely to be frictionally heated between the spiral blade 107*b* and container bearing portion 30. Therefore, it is possible to prevent the problem that the developer is likely to be made to agglomerate between the spiral blade 107*b* and container bearing portion 30. As described above, according to this embodiment, it is possible to accomplish both the objective of preventing a conveyance screw such as the stirring screw 107 from wobbling as it is rotated, and the objective of preventing the developer agglomeration attributable to the rotation of the conveyance screw.

Other Embodiments

By the way, the embodiment of the present invention described above is not intended to limit the present invention is scope. That is, not only is the present invention is applicable to a process cartridge, but also, other developer storing apparatuses, such as a development cartridge, a cleaning apparatus, and an apparatus for replenishing a developing device with toner, which have an internal conveyance screw for conveying developer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-164717 filed on Aug. 29, 2017, which is hereby incorporated by reference herein in its entirety.

What is claimed is:

1. A developing device comprising:

an accommodation frame for accommodating a developer;

a feeding screw including a shaft portion and a helical blade formed on said shaft portion and configured to feed the developer in said accommodation frame by rotation thereof;

a supporting member provided with a gear engaged with one end portion of said shaft portion to transmit a rotational force to said feeding screw; and a bearing portion for rotatably supporting said supporting member, wherein in a state that said supporting member is supported by said bearing portion, said one end portion is inside said accommodation frame, and wherein in the state that said supporting member is supported by said bearing portion, a first distance between an end portion of said bearing portion in a rotational axis direction and an end portion of said helical blade closest to said bearing portion is larger than a second distance between the end portion of said bearing portion and an end surface of said shaft portion.

2. A device according to claim 1, wherein a difference between the first distance and the second distance is not less than 1 mm and not more than 2 mm.

3. A device according to claim 1, wherein said supporting member includes a supported portion supported by said bearing portion and an engaging portion engaging with said shaft portion, and a diameter of said supported portion is smaller than a diameter of said gear and is smaller than a diameter of said shaft portion.

4. A device according to claim 1, wherein said shaft portion of said feeding screw and said helical blade of said shaft portion are an integrally molded resin material product.

5. A device according to claim 1, wherein said supporting member is an integrally molded resin material product.

6. A device according to claim 1, wherein the other end portion of said shaft portion is rotatably supported by another bearing portion provided in said accommodation frame.

* * * * *